US005417023A

United States Patent [19]

Mandish

[11] Patent Number: 5,417,023

[45] Date of Patent: May 23, 1995

[54] BUILDING PANEL APPARATUS AND METHOD

[76] Inventor: Theodore O. Mandish, 5055 State Road 46, Mims, Fla. 32754

[21] Appl. No.: 173,058

[22] Filed: Dec. 27, 1993

[51] Int. Cl.[6] ..... E04C 3/30; E04C 2/06

[52] U.S. Cl. ..... 52/348; 52/309.9; 52/309.14; 52/481.1; 52/656.1; 52/727; 52/731.5; 52/731.9; 52/732.3

[58] Field of Search ..... 52/309.14, 309.9, 344, 52/348, 362, 363, 653.1, 656.1, 727, 730.1, 730.4, 730.6, 731.1, 731.2, 731.4, 731.5, 731.8, 731.9, 732.1, 732.3, 481.1

[56] References Cited

U.S. PATENT DOCUMENTS

| | | | |
|---|---|---|---|
| 1,200,639 | 10/1916 | Moore et al. | 52/804 |
| 1,793,634 | 3/1927 | Plunkett | 52/363 X |
| 2,032,922 | 9/1930 | Driver | 52/731.5 |
| 2,173,721 | 9/1939 | McGee | 52/348 |
| 3,305,981 | 2/1967 | Biggs et al. | 52/481.1 X |
| 3,363,371 | 1/1968 | Villalobos | 52/91.3 X |
| 3,859,765 | 1/1975 | Nelsson | 52/481 X |
| 4,002,001 | 1/1977 | Uydess | 52/731 X |
| 4,038,802 | 8/1977 | Bajorek et al. | 52/731.4 X |
| 4,205,497 | 6/1980 | Schirm | 52/731 X |
| 4,512,129 | 4/1985 | Riggs | 52/731 X |
| 4,558,552 | 12/1985 | Reitter, II | 52/741 |
| 4,580,380 | 4/1986 | Ballard | 52/309.9 |
| 4,619,098 | 10/1986 | Taylor | 52/738 |
| 4,683,019 | 7/1987 | Motoki | 52/344 X |
| 4,854,096 | 8/1989 | Smolik | 52/732 X |
| 5,022,205 | 6/1991 | Ford | 52/309.9 X |
| 5,036,637 | 8/1991 | Biebuyck | 52/730.4 |
| 5,092,100 | 3/1992 | Lambert et al. | 52/481.1 X |
| 5,095,678 | 3/1992 | Murphy | 52/731 |
| 5,218,803 | 6/1993 | Wright | 52/481.1 X |

*Primary Examiner*—Michael Safavi
*Assistant Examiner*—Wynn E. Wood
*Attorney, Agent, or Firm*—William M. Hobby, III

[57] ABSTRACT

A prefabricated panel is made of a plurality of elongated metal frame members attached together to form a panel framework. At least one stud is attached between two of the panel frame members and has a pair of elongated stud members attached together at each end thereof with a molded polymer composite end member to form a thermal break therein. A metal reinforcing rod is attached to each molded composite end member and extends the length of the stud and may be attached through to the roof rafters or trusses. The prefabricated panel may be filled with insulation and have an expanded metal mesh covering on one side to act as a stiffening for the framework and to support a lightweight concrete coating. A method of making a reinforcing stud and panel is provided including molding a pair of end stud members in a predetermined shape and selecting a pair of elongated metal stud members shaped for attachment to the molded end stud members and attaching each stud member at each end to one of the molded end members. An elongated reinforcing metal member is attached through the stud and to each molded end member to provide a reinforcing stud member easily attached to a panel. The method further includes attaching the reinforcing stud into a prefabricated panel.

13 Claims, 2 Drawing Sheets

BUILDING PANEL APPARATUS AND METHOD

BACKGROUND OF THE INVENTION

The present invention relates to a prefabricated panel and especially to a prefabricated panel having a reinforcing stud member formed therein and to a method of making a reinforcing stud member and prefabricated panel.

Building panels of various kinds have been constructed over the years with a variety of external facings and with different insulating materials formed within each panel. Prefabricated panels are frequently made up in a factory and shipped to a site for forming interior and exterior walls of a building. The panels are also made directly at the building site. Such prior panels typically have a framework commonly of wood or metal studs preformed with insulation in the panel and sometimes having electrical wirings formed therein. Prefabricated panels frequently have means for attaching the panels along abutting edges and for attaching roof trusses or rafters to one edge of the panels and for attaching the panels to a flooring or the footers in the construction of a building. Panels typically have been constructed to withstand various types of forces especially compression forces from the weight of the roof and compression loads that are placed on a roof. Such panels have also been designed to provide insulation and a weather-tight sealing between the panels and to be connected to adjacent panels and to footers. The panels have, however, typically been connected to roof truss or rafters using conventional brackets which are nailed to the wooden rafters or truss and to wooden headers. The brackets are designed to withstand a certain wind force. The top of a building acts like an airfoil to the air currents passing through and creates a lifting force on the roof. Brackets have been designed to hold the roof to the wall headers and to withstand normal lifting forces encountered by strong winds. However, when a hurricane or other very large wind forces are encountered, buildings have frequently been destroyed by the roof being pulled away by the lifting force of the high velocity wind currents passing over the roof. Even when the walls are well attached to the roof, the buildings have been destroyed by lifting both the roof panels and the walls, breaking the walls loose from concrete slabs or poured footers.

The present invention is directed towards a wall panel which not only provides support for compression forces but also anchors the building walls and roof together in such a manner as to provide a greatly increased strength in tension against the lifting forces placed on roofs to prevent the roof of the building from being pulled away from the foundation of the building.

Prior art U.S. patents for prefabricated building panels, walls, and wall studs can be seen in the Reitter U.S. Pat. No. 4,558,552, for a building panel and process for making the same using a framework of metal channels having pressed fiberglass fibers attached to one surface and in the Smolik U.S. Pat. No. 4,854,096, for a wall assembly using vertical metal wall studs assembled to horizontal channel shaped members or beams to form a framework for mounting drywall construction. In the Villalobos U.S. Pat. No. 3,363,371, the erection of a prefabricated house uses a building panel having a rectangular frame and includes a plurality of reinforcing members secured within the frame by tabs at the ends of the members and extending horizontally within the frame. In the Plunkett U.S. Pat. No. 1,793,634, a reinforced stucco and plaster backing sheet is provided for a wall structure. In the A. H. Moore and E. F. Morton U.S. Pat. No. 1,200,639, a sheet metal construction is illustrated for a partition in a building. In the Taylor U.S. Pat. No. 4,619,098, a metallic structural member for supporting walls and floors of a building is provided which uses a channel-shaped metallic stud mounted in steel runner plates. The Schirm U.S. Pat. No. 4,205,497, shows a building with a frame or skeletal structure using interconnecting metal studs and frame members. Special designed metal stud members can be seen in the Nelsson U.S. Pat. No. 3,859,765, for a demountable partition assembly in which metal studs are formed for attaching and holding abutting edges of wall panel. In the Uydess U.S. Pat. No. 4,002,001, a wall stud for securing plasterboard to masonry, bricks, blocks and the like is shown while in the Murphy Pat. No. 5,095,678, a structural beam having an open faced end flange that can be strap fitted to the end of a similar stud is shown. In the Riggs U.S. Pat. No. 4,512,129, an electro stud has a hollow metal stud with a thin wall conduit pipe for the electrical wiring attached therein. The Driver U.S. Pat. No. 2,032,922, shows a post for steel partitions.

In contrast to the prior art, the present invention has hollow steel studs which have molded end plates for attaching a pair of elongated metal stud members together such that fasteners can be easily attached into the molded composite members for attaching the studs within a wall panel and are used to support reinforcing metal bars extending through the stud which can be attached from the foundation through to the headers and to the rafters or roof trusses using steel brackets to provide wall panels which can withstand both compression and tension forces applied to the building.

SUMMARY OF THE INVENTION

A prefabricated panel is made of a plurality of elongated metal frame members attached together to form a panel framework. At least one stud is attached between two of the panel frame members and has a pair of elongated stud members attached together at each end thereof with a molded polymer composite end member to form a thermal break therein. A metal reinforcing rod is attached to each molded composite end member and extends the length of the stud and may be attached through to the roof rafters or trusses. The prefabricated panel may be filled with insulation and have an expanded metal mesh covering on one side to act as a stiffening for the framework and to support a lightweight concrete coating. A method of making a reinforcing stud and panel is provided including molding a pair of end stud members in a predetermined shape and selecting a pair of elongated metal stud members shaped for attachment to the molded end stud members and attaching each stud member at each end to one of the molded end members. An elongated reinforcing metal member is attached through the stud and to each molded end member to provide a reinforcing stud member easily attached to a panel. The method further includes attaching the reinforcing stud into a prefabricated panel.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
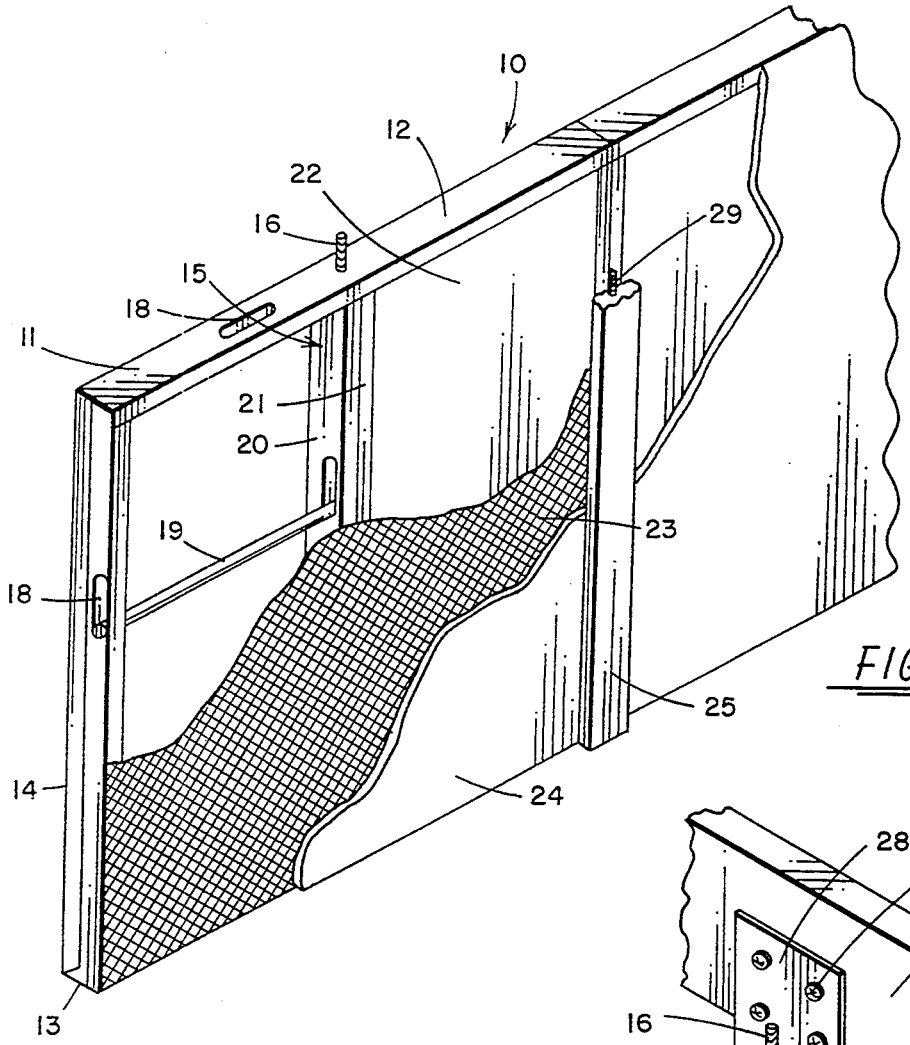
FIG. 1 is a cutaway perspective of a wall panel in accordance with the present invention.

Referring to the drawings and especially to FIG. 1, a prefabricated wall panel 10 is illustrated having a panel framework 11 including a top metal frame member or beam 12, a bottom frame member 13, and a pair of end frame members 14. The building panel 10 includes a central reinforcing metal stud 15 having a thermal break therein mounted between frame members 12 and 13 which has a reinforcing metal bar member (rebar) 16 passing therethrough and extending through the frame member 12. The frame member 11 may have a plurality of apertures or slots 18 therethrough for passing of electrical conduit therethrough. The stud 15 is made up of first elongated stud member 20 and second elongated stud member 21 which have been attached to form a hollow metal stud 15. Metal stud members 20 and 21 are attached with a pair of molded composite blocks, as will be described hereinafter.

The panel 10 has insulation 22 placed within the panel, which insulation can be a fiberglass or a polymer foam insulation as desired. The panel has one exterior side thereof having an expanded metal screen or mesh 23 attached to the frame 11 and to the center stud member 15. The expanded metal mesh 23 is attached with self-tapping screws to the metal frame members 14 and 12 and to the surface of the center stud 15 and provides additional strength to the overall panel to make the panel 10 act as a unit in which forces against the frame are resisted when a tension is applied to the expanded metal mesh 23. The expanded metal mesh 23 is then coated with a lightweight concrete material 24 which can be spray applied or hand applied as desired. The lightweight concrete 24 is anticipated as being a cement composition filled with polystyrene beads or other lightweight or expanded materials such as taught in Applicant's prior U.S. Pat. No. 4,011,355 which provides a method for coating lightweight beads to assure that they have uniform dispersion in the material as well as greater strength by the adhesion of the cement to the beads or other lightweight materials. This cementitious coating from 24 also adds additional insulative value to the panel when worked in combination with the insulation 22 and, in addition, strengthens the panel and is fire retardant. When used as an exterior panel, it provides essentially a concrete wall which also reduces the transmission of sound by virtue of low resonance of concrete surface material. An insultation strip 29 is keyed to a stud interface between two panels and acts as an inner sealer strip to prevent thermal migration. A weather sealer strip 25 may be attached to one end of each panel for use in attaching pairs of panels to abutting ends.

Figure 2:
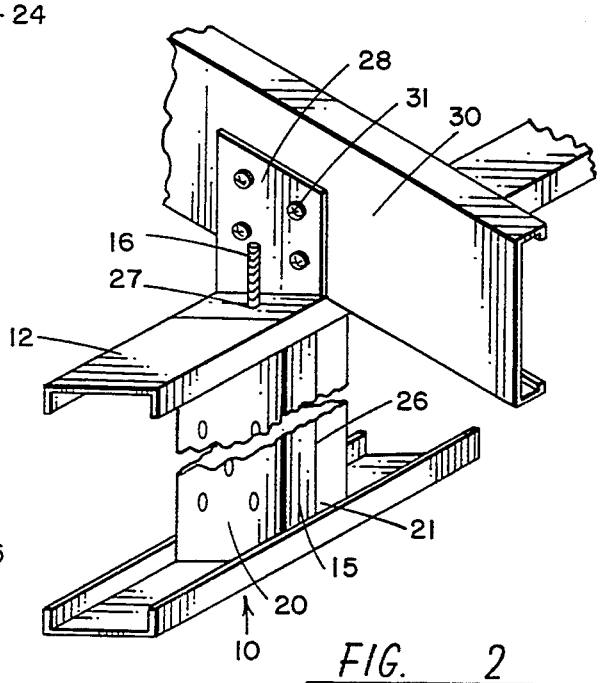
FIG. 2 is a broken away perspective of the connection of a portion of a wall panel of FIG. 1 attached to a rafter.

Turning to FIG. 2, a perspective view of a portion of the panel 10 is illustrated with the lower metal channel of framework member 13 and the upper framework member 12 having the reinforcing metal stud 15 mounted therebetween. Stud 15 has a thermal break 26 between the metal stud members 20 and 21 and are shaped to fit exactly within the U-shaped channel frame members 12 and 13. The reinforcing metal bar 16 can be extended through the frame member 12 and through an opening 27 in a rafter bracket or clip 28. The reinforcing bar 16 is attached to the rafter clip 28 and the rafter clip is attached to the rafter 30 with the fasteners 31. The metal rafters 30 are also of a channel shape and may be anchored with self-tapping screws. It may also be attached with bolts or the like. The metal reinforcing member 16 is welded to the rafter clip 28 but could be attached in any other manner desired without departing from the spirit and scope of the invention.

Figure 5:
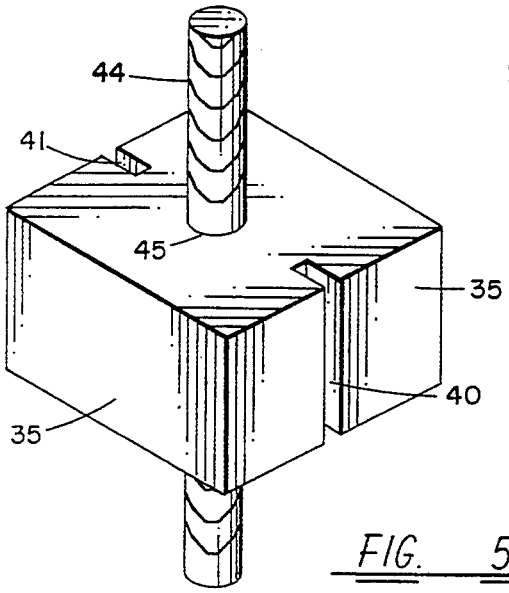
FIG. 5 is a perspective view of a portion of the metal stud end blocks in accordance with FIG. 4.
Figure 3:
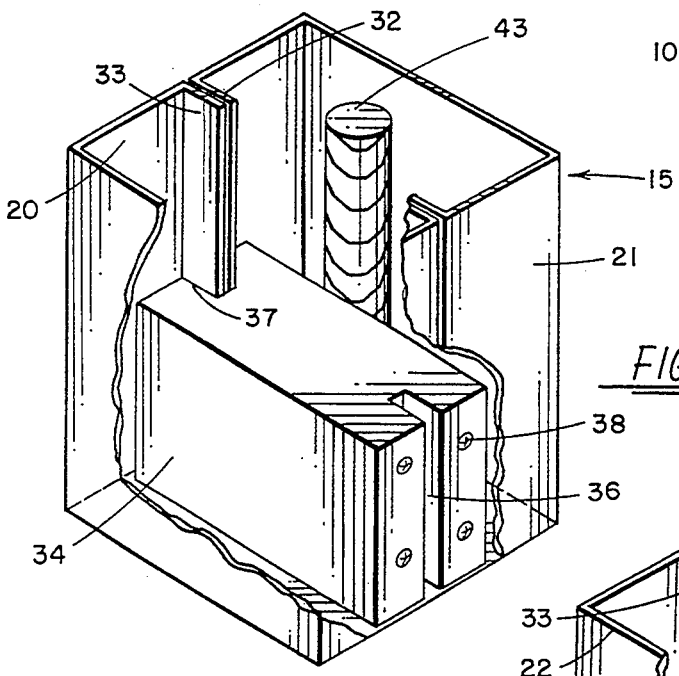
FIG. 3 is a perspective view having portions cutaway of the metal stud in accordance with the present invention.
Figure 4:
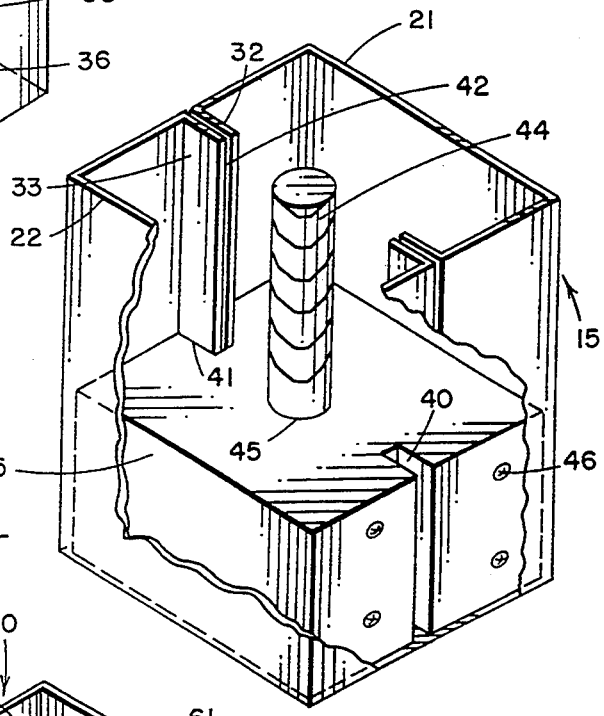
FIG. 4 is a perspective view of a portion of an alternate embodiment of a metal stud in accordance with the present invention.

Turning to FIGS. 3, 4 and 5, a reinforcing rafter 15 is seen having elongated metal stud members 20 and 21 of a general channel shape having the inwardly protruding flange edges 32 on the stud member 21 and the flange edges 33 on the elongated metal stud member 20. The framework and stud metal members can be made of a lightweight sheet metal, such as steel, which can be formed with a shaping die drawing the metal portions therethrough. A molded composite plastic block 34 in FIG. 3 and 35 in FIG. 4 and in FIG. 5 is formed of a polymer composite which may be filled with wood chips or fibers filling inexpensive polymer material, such as a thermo-setting plastic which is molded and compressed to form blocks which can be screwed or nailed into. The blocks are shaped, as shown in FIGS. 3 and 4.

The block 34 having a pair of slots 36 and 37 on either end thereof which allows the block to be slid between two of the elongated stud members 20 and 21 so that their flanges 32 and 33 fit within the slots 36 and 37 to form a thermal break between the elongated steel stud members 20 and 21. A plurality of fasteners, such as screws 38 can then attach the stud members directly to the molded block 34 at each end of the stud 15 so that the stud is supported with the molded blocks 34 at each end which also makes it easier for the stud to be attached to the upper and lower frame members 12 and 13 which can be attached directly into the composite block 34. Composite block 35 in FIGS. 4 and 5 is similar to the composite block 34 and has a pair of slots 40 and 41 on opposite sides of the composite block 34 for the elongated stud member flanges 32 and 33 to slide thereinto to hold the elongated stud members 20 and 21 together with a thermal break 42 therebetween which may have an insulation strip placed therein.

In the stud 15 of FIG. 3, a reinforcing metal bar or rebar member 43 has been mounted adjacent the block 34 while in FIGS. 4 and 5, the rebar steel 44 is mounted through an aperture 45 passing through the block 35 to allow the rebar to be anchored to the composite block 35 and also to frame members 12 and 13 at each end of the panel 10. In addition, the rebar 43 or 44 can extend through the panel frame members 12 and 13 at each end for attaching the rebar directly to a reinforcing rafter or roof truss bracket for firmly anchoring the roof truss and roof to the rebar steel and to the panel. While the opposite end of the rebar 43 or 44 can be attached to the reinforcing steel extending from poured footers or it can be otherwise anchored to a foundation. The steel rebar provides not only additional strength against compression loads applied to the roof but also provides a much greater resistance to the tension loads applied by strong winds passing over the roof of the building and applying a lifting force to the roof of a building. The advantages of the stud as illustrated is that it provides a thermal broken space between the stud members and within the panel and simultaneously provides a very strong building panel when combined with the attached expanded metal mesh. The stud adds a much greater resistance to both tension and compression forces placed on the panel. A lightweight concrete exterior surface resists weather forces while providing additional insulation.

Figure 6:
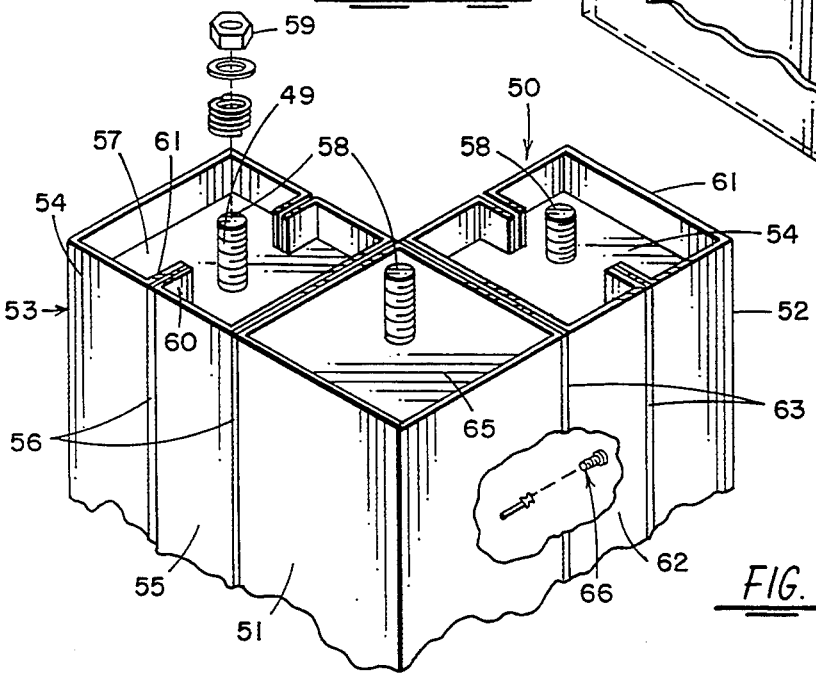
FIG. 6 is a partial perspective view of a corner post connection.

A corner post connection 50 is illustrated in FIG. 6 in a partial perspective view in which a square corner metal post 51 has a pair of hollow metal studs 52 and 53 attached to two sides thereof. Studs 52 and 53 are part of the panels in accordance with FIG. 1. The stud 53 has a pair of elongated metal channels 54 and 55 attached together with a thermal strip 56. The channel 55 abuts one side of the metal post 51 with an expansion and insulating strip placed therebetween. Channel portions 54 and 55 have a flange portion 60 and 61 where they come together onto the thermal expansion strips 56 and are held in the composite block 57 which is placed at each end of the stud and has the rebar member 58 extending therethrough. Rebar 58 has a threaded end 49 for receiving the nut and washers 59 thereon for attaching headers thereto. Similarly, the stud 52 has the composite block 64 attached between elongated metal channels 61 and 62 supported with a thermal insulation strip 63 placed therebetween. The post are attached with thread fasteners 66, as shown from the cutaway, attaching each of the metal studs directly to the corner post 51. Metal post 51 has a rebar member 58 extending through the center thereof and is poured full of concrete or a lightweight concrete to give a reinforced concrete post with a metal skin. The post is further reinforced by the strengthened metal studs 52 and 53 attached to two sides thereof and with insulating and thermal strips placed between the corner posts 51 and a pair of studs 52 and 53 for sealing and providing for thermal expansion. This system allows the rapid connection of the corner post and the panels together with a very rigid structure anchoring the corners to the roof and to the panels so as to act as one unit with greater strength against high winds and other forces that are applied against the structure.

Figure 7:
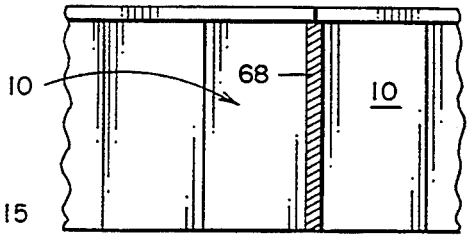
FIG. 7 is a side elevation of two adjoining panels connected with a crush panel.

FIG. 7 shows two adjoining panels 10 connected with a crush panel 68. The panel 68 can be made of rigid polystyrene or other material having a give to it to allow movement in the wall in case of a earthquake. Only one panel 68 is needed in each side wall.

A method of building the building panel of FIG. 1 with the reinforcing stud of FIGS. 3, 4 and 5 includes the step of molding a polymer composite block 34 and 35 of a shape having slots passing on two sides, then forming elongated metal stud members having flanges exactly adapted for the composite blocks 35 to hold the flanges together to form a thermal broken metal stud which is easily attached to the metal stud with screw fasteners 38 and 46. The rebar 43 and 44 is attached through the center of the metal stud and to the composite blocks 34 and 35, the studs are then attached within the panel 10 of FIG. 1, which may have a framework assembled, and has the expanded metal mesh attached over a surface and a lightweight concrete coated onto the expanded metal mesh. The method also includes the attaching of insulation 22 within the panel and the attaching of a rafter bracket 28 to the rebar 14, 43, or 44 and to the rafter for greatly increasing the strength of the building in tension and compression while providing a thermal break in the stud which is strengthened by the molded composite blocks which can be easily nailed or screw threaded thereinto for both holding the stud together and holding the stud to the panel frame members.

It should be clear at this time that an improved metal stud and building panel have been provided which improves the construction of a building panel for the building of a building. A method for building the panel and improved metal stud with molded composite ends has also been taught. However, the present invention is not to be construed as limited to the forms shown which are to be considered illustrative rather than restrictive.

I claim:

1. A prefabricated panel comprising:

a plurality of elongated panel frame members attached together to form a panel framework;

a stud attached between two panel frame members, said stud having a pair of elongated stud members attached together at each end thereof with a molded composite end member and a metal reinforcing rod extending through said attached elongated stud members and being attached to each said molded composite end member thus forming a tension reinforced stud; and a panel side covering at least one side of said panel framework; whereby a prefabricated panel has increased strength from the tension reinforced stud attached in the framework.

2. A prefabricated panel molded in accordance with claim 1 in which each molded composite end member is of a molded polymer block filled with wooden pieces.

3. A prefabricated panel molded in accordance with claim 2 including an expanded metal screen attached to one side of said frame and stud and said metal screen being coated with a light weight concrete whereby a lightweight panel is formed with a concrete surface.

4. A prefabricated panel molded in accordance with claim 3 in which both sides of said frame have metal screens attached thereto.

5. A prefabricated panel molded in accordance with claim 4 in which said light weight coating includes a cement filled with lightweight polystyrene beads.

6. A prefabricated panel molded in accordance with claim 5 in which said pair of elongated stud members are U-shaped steel members having edge flanges supported in slots formed in each said molded composite member to thereby form a firebreak in said metal stud.

7. A prefabricated panel molded in accordance with claim 6 in which said pair of elongated stud members are U-shaped steel members and are attached with fasteners therethrough to each said molded composite member.

8. A prefabricated panel molded in accordance with claim 7 in which said metal reinforcing rod extends through each end of said molded composite member and is attached to one frame member.

9. A prefabricated panel molded in accordance with claim 8 in which said metal reinforcing rod is attached to a rafter bracket for attachment to a building roof.

10. A reinforcing stud for a building panel comprising:

a pair of molded end stud members having a predetermined shape and being formed as a molded block of polymer having a filler therein, each said end stud member having at least one slot formed therein;

a pair of elongated metal stud members, each end of each of said elongated metal stud members being attached to one said molded end stud member;

attaching an elongated reinforcing metal member to each said molded end member so that said elongated reinforcing metal member extends through said elongated metal stud members, whereby a prefabricated stud is easily attached in a wall panel to provide center reinforcing extending the length thereof.

11. A reinforcing stud for a building panel in accordance with claim 10 in which said reinforcing metal member is adapted to be attached at one end to a rafter bracket for attachment to a building rafter.

12. A reinforcing stud for a building panel in accordance with claim 11 in which said reinforcing stud is adapted to be attached in a preformed wall panel frame and having said reinforcing metal member extending through one end of said frame.

13. A reinforcing stud for a building panel in accordance with claim 10 in which each said molded end stud member has two slots formed therein for supporting flanges on each said elongated metal stud member therein to form a thermal break in said stud.

* * * * *